US010410544B1

(12) United States Patent
Welker

(10) Patent No.: US 10,410,544 B1
(45) Date of Patent: Sep. 10, 2019

(54) MERCHANDISE DISPLAY STAND

(71) Applicant: ImageWorks Display and Marketing Group, Inc., Winston-Salem, NC (US)

(72) Inventor: Brian Hart Welker, Summerfield, NC (US)

(73) Assignee: Imageworks Display and Marketing Group, Inc., Winston-Salem, NC (US)

( * ) Notice: Subject to any disclaimer, the term of this patent is extended or adjusted under 35 U.S.C. 154(b) by 0 days.

(21) Appl. No.: 16/173,310

(22) Filed: Oct. 29, 2018

(51) Int. Cl.
*G09F 3/20* (2006.01)
*A47F 5/00* (2006.01)
*A47F 5/10* (2006.01)

(52) U.S. Cl.
CPC ..... *G09F 3/204* (2013.01); *A47F 5/0068* (2013.01); *A47F 5/103* (2013.01); *A47F 2005/0075* (2013.01)

(58) Field of Classification Search
CPC ..... G09F 3/204; A47F 5/0068; A47F 5/103; A47F 2005/0075; F21V 21/35; H01R 4/2404; H01R 4/245; H01R 4/26
See application file for complete search history.

(56) References Cited

U.S. PATENT DOCUMENTS 3,296,725 A * 1/1967 Fenwick ..... G09F 1/14 40/607.1
4,467,925 A * 8/1984 Ratzloff ..... B25H 3/04 211/103
4,798,013 A * 1/1989 Sainato ..... G09F 1/10 211/102
4,884,351 A * 12/1989 Abramson ..... G09F 7/10 40/611.05
5,454,638 A * 10/1995 Bird ..... A47B 57/42 108/108
5,582,376 A * 12/1996 Thompson ..... A47B 96/067 211/94.01
5,921,411 A * 7/1999 Merl ..... A47B 96/00 108/108
6,434,871 B2 * 8/2002 Conway ..... G09F 3/204 40/642.02
6,860,456 B2 * 3/2005 Magnusson ..... A47B 47/027 211/206
7,690,519 B2 * 4/2010 Kahl ..... A47F 1/12 211/126.1
8,061,539 B2 * 11/2011 Punzel ..... A47B 57/10 108/108
9,082,323 B1 * 7/2015 Dougherty ..... G09F 23/06
9,142,150 B2 * 9/2015 Logan ..... G09F 7/18

* cited by examiner

*Primary Examiner* — Ko H Chan
(74) *Attorney, Agent, or Firm* — NK Patent Law

(57) ABSTRACT

A merchandise display stand includes a pair of brackets for carrying a panel having advertising indicia on a first end thereof. A plurality of spaced-apart upright supports extend vertically, and a channel extends across a horizontal support that spans the spaced-apart upright supports. The channel defines an upper and lower flange. The upper and lower flange define a space therebetween for selectively receiving a power cord. Each bracket defines a pair of shoulders on a second end thereof. Each of the shoulders is configured for engaging with a respective flange to receivably engage each of the brackets with the channel.

15 Claims, 5 Drawing Sheets

MERCHANDISE DISPLAY STAND

BACKGROUND

Field of the Invention

The present invention relates to a merchandise display stand, and, more particularly, towards a merchandise display stand configured for having improved structural performance and ease of use.

Description of Related Art

Merchandise display stands are used for displaying merchandise. There are several varieties available, each providing various purposes and intents, each also having various advantages and disadvantages.

One commonality among most merchandise display stands is the ability to configure the shelves and spacing thereof in order to accommodate merchandise of various size and configuration, as well as to fit within available spacing in a retail establishment, as an example. The stands must be highly adaptable in order to accommodate these various considerations.

One problem with conventional merchandise display stands is that the shelving often uses conventional hook style fasteners that insert into corresponding recesses formed in an upright support bracket for the display stand. This provides a shelving system of sufficient structural integrity, however, the system cannot accommodate selective horizontal movement. In fact, the horizontal movement is largely limited to the spacing between adjacent uprights. When advertising indicia associated with the stands has a limited or specific dimension, such as a specific width, associating the advertising with the merchandise in a visually pleasing way can be compromised when adjustability is limited.

BRIEF SUMMARY

According to one embodiment of the present invention, a merchandise display stand includes a pair of brackets for carrying a panel having advertising indicia on a first end thereof. A plurality of spaced-apart upright supports are supported by a channel extending across a horizontal support that spans the spaced-apart upright supports. The channel defines an upper and lower flange. The upper and lower flange may define a space therebetween for selectively receiving a power cord. Each bracket may define a pair of shoulders on a second end thereof, each of the shoulders configured for engaging with a respective flange to receivably engage each of the brackets with the channel.

According to one or more embodiments, placement of the pair of brackets occurs in response to sliding of the brackets along a length of the channel.

According to one or more embodiments, each bracket defines a set screw on a top surface thereof that extends through the bracket.

According to one or more embodiments, the merchandise display stand includes a shelf platform having a pair of shoulders configured for engaging with respective flanges of the channel to receivably engage the shelf platform with the channel.

According to one or more embodiments, the merchandise display stand includes a cover that defines a major length thereof. The cover has a pair of shoulders on terminal ends of a minor length thereof and configured for engaging with respective flanges of the channel to receivably engage the cover with the channel to conceal a power cord carried within the channel.

According to one or more embodiments, the merchandise display stand further includes recesses in the spaced-apart upright supports for receiving a hook and anchor of a shelving system for supporting merchandise.

According to one or more embodiments, a support extends from the horizontal support at a position spaced-below the flanges for providing an area of increased rigidity.

According to one or more embodiments, the channel is positioned external to the upright supports.

According to one or more embodiments, the brackets can be selectively engaged with the channel only through slideable engagement with an end of the channel.

According to one or more embodiments, the brackets are of rigid construction.

DETAILED DESCRIPTION

Figure 1:
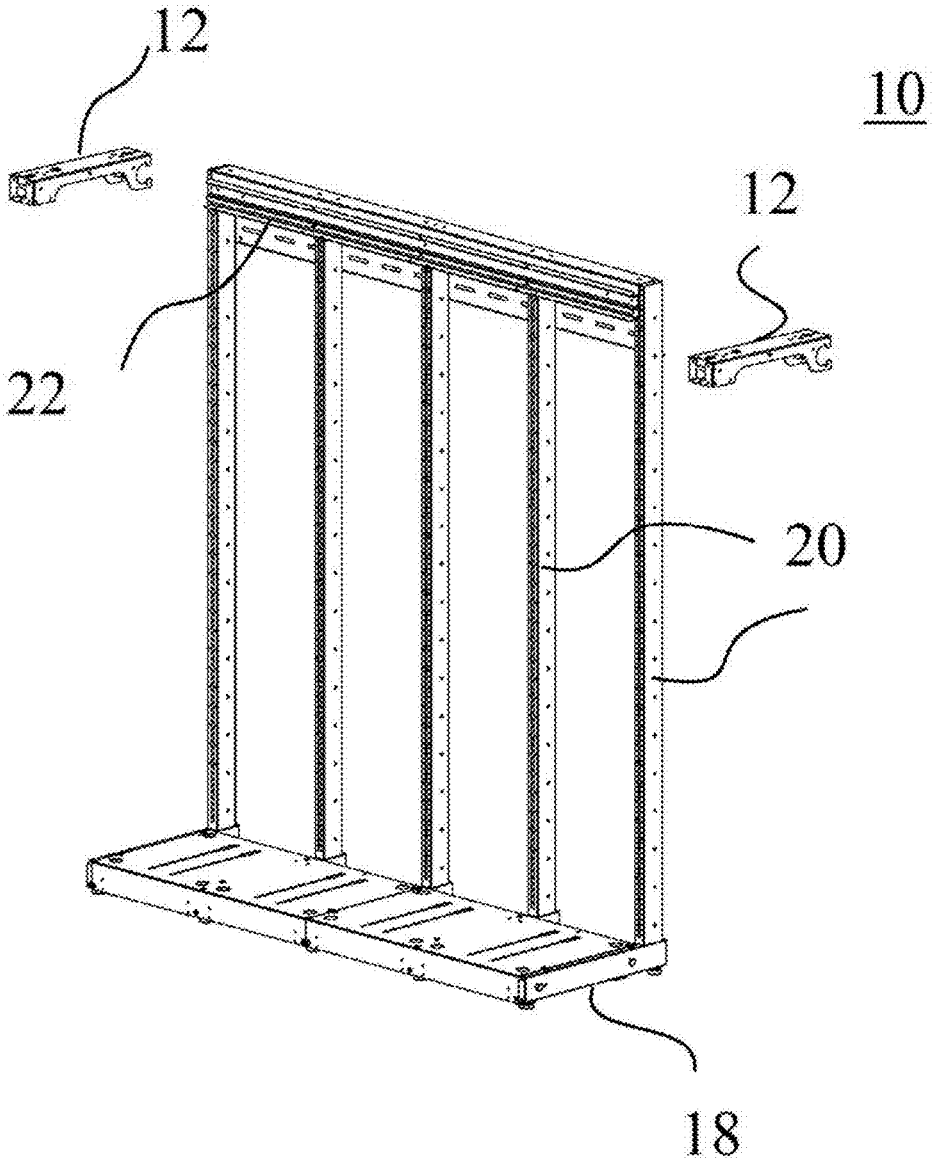
FIG. 1 illustrates an exploded perspective view of a merchandise display stand according to one or more embodiments disclosed herein.
Figure 2A:
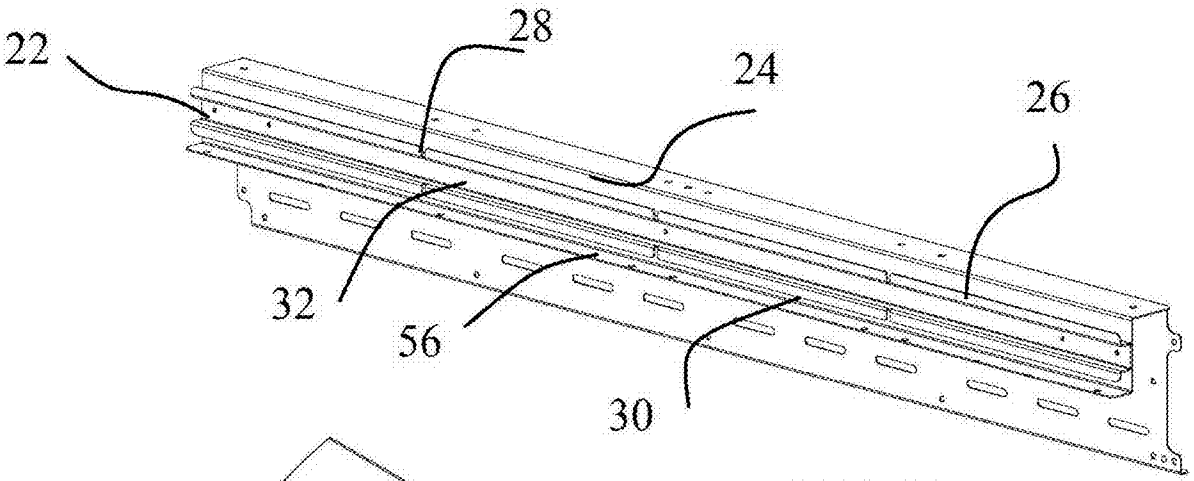
FIGS. 2A and 2B illustrate perspective views of a channel support according to one or more embodiments disclosed herein.
Figure 2B:
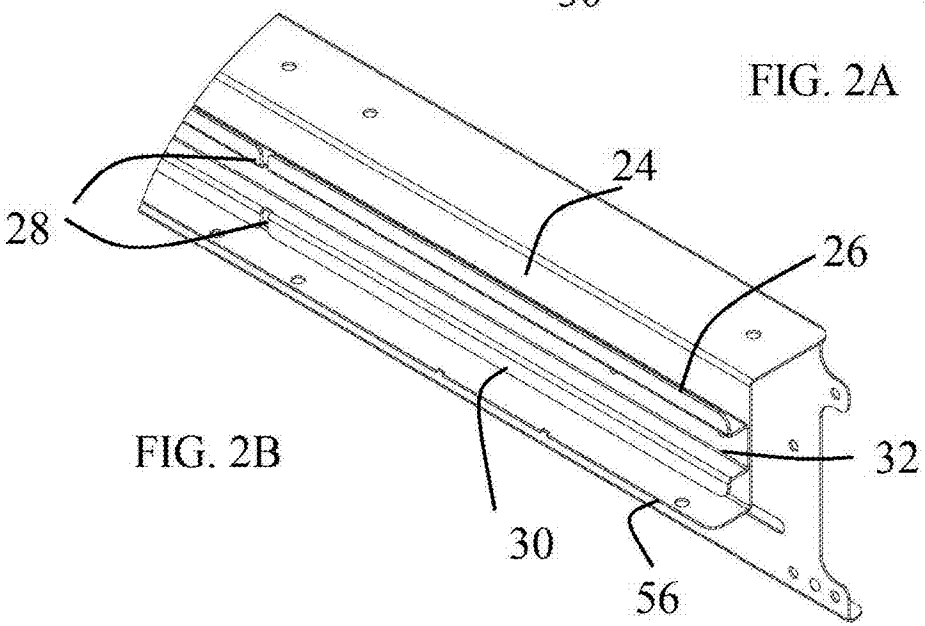

A merchandise display stand is illustrated throughout the drawings and is generally designated 10. The merchandise display stand 10 may be used in any appropriate setting or circumstance, including in a retail setting such as for displaying merchandise for selection and purchase by a consumer. The merchandise display stand 10 may be positioned proximal a wall or other structure for being secured in place. Any suitable fastener may be employed for securing the merchandise display stand 10 to the wall. Various components associated with this particular display stand are also illustrated.

A pair of rigid brackets 12 for carrying a panel 14 having advertising indicia 16 on a first end thereof is also provided. The brackets 12 are shown in a certain shape and configuration, but many other configurations could be employed. Additionally, the number of brackets 12 can be adjusted as needed. Advantageously, the spacing of the brackets 12 can be adjusted in an improved manner, which is described with further reference herein.

The display stand 10 includes a plurality of spaced-apart upright supports 20. The supports 20 may be conventional in nature, having consecutively spaced-apart recesses that allow for installation of a hook style fastener known in the art. The hook style fastener may then receive one or more shelves, which may be any appropriately configured shelf for holding merchandise and the like. As illustrated, there are five upright supports 20 for this particular display stand, but any appropriate number may be selected and/or used. A support base 18 may also be provided.

A channel is generally designated 22 and extends across a horizontal support 24 that spans the spaced-apart upright supports 20. The channel 22 defines an upper flange 26 and a lower flange 30. The upper flange 26 and lower flange 30 define a space 32 therebetween for selectively receiving a power cord. Each bracket 12 may define a pair of shoulders 34, 36 on a second end thereof. Each of the shoulders 34, 36 may be configured for engaging with a respective flange 26, 30 to receivably engage each of the brackets 12 with the channel 22. Advantageously, placement of the pair of brackets 12 occurs in response to sliding of the brackets 12 along a length of the channel 22. In this manner, the brackets 12 may be positioned in any desired position to accommodate advertising indicia 16 of various sizes and configuration.

As further illustrated, notches 28 are formed in the upper flange 26 and lower flange 30 for receipt of the brackets 12 to avoid entire end-loading. In this manner, and as will be further described herein, when a user wants to place a bracket 12 in a given location, the user will locate a proximal notch 28 to allow insertion of a bracket 12 to then provide for slideable engagement of the bracket 12 with channel 22.

Figure 4:
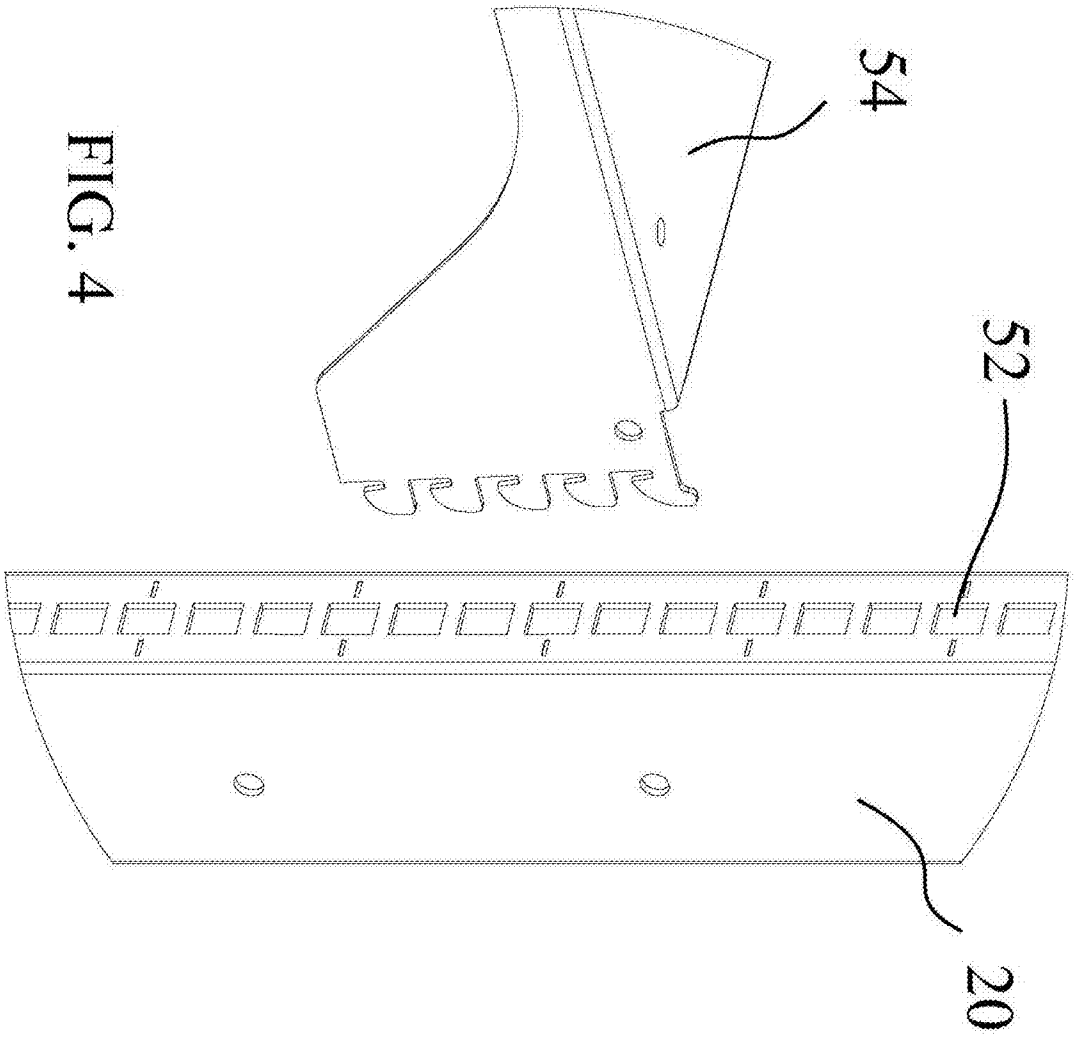
FIG. 4 illustrates a conventional hook and recess fastener system according to one or more embodiments disclosed herein.
Figure 5:
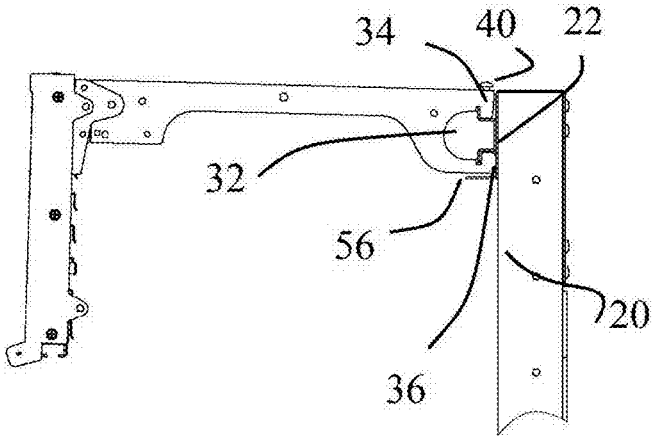
FIG. 5 illustrates a side view of a bracket engaged with a channel support according to one or more embodiments disclosed herein.
Figure 7:
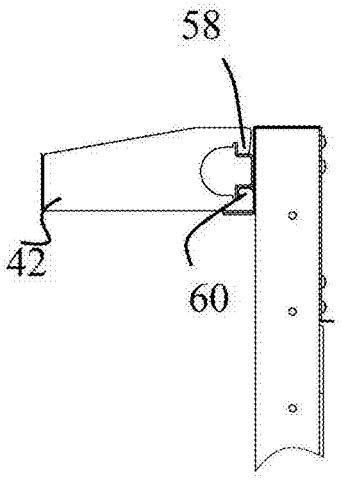
FIG. 7 illustrates a side view of a shelf platform engaged with a channel support according to one or more embodiments disclosed herein.

As illustrated in FIG. 5, a support 56 extends from the horizontal support 24 at a position spaced-below the flanges. This advantageously provides additional support to the assembly as a whole by providing a stress point about the perpendicular bend in the support 56, while also visually guiding the user that the proper method for installation is sliding horizontally along channel 22 as opposed to a traditional "insert and rotate" mechanism that is generally employed that is illustrated in FIG. 4 where hooks are illustrated as 54 and recesses 52. This conventional mechanism is disadvantageous for a plurality of reasons, including the fact that the user will often place the inserted hook into an unlevel opening relative to another bracket, thus causing a tilt in the shelf. Additionally, the conventional mechanism requires increased vertical spacing to insert the shelf and this can be particularly problematic when installing near a ceiling, as well as the aforementioned limited ability to manipulate horizontal movement of the bracket and shelf system. As illustrated, the channel 22 is positioned external to the horizontal support 24. Similarly, FIG. 7 illustrates shelf platform 42 having shoulders 58 and 60 for engaging the channel 22.

Figure 6:
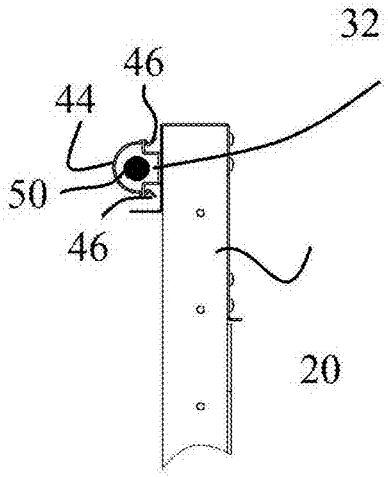
FIG. 6 illustrates a side view of a cover engaged with a channel support according to one or more embodiments disclosed herein.

As illustrated with further reference to FIG. 5, each bracket 12 may define a set screw 40 that can be extended into the bracket for engagement with upper flange 26 by insertion into a channel defined therein to further secure the bracket 12 in both a horizontal and yaw direction. Similarly, as illustrated in FIG. 6, a cover 44 that defines a major length thereof (the long direction is shown coming out of the page) may be provided. The cover 44 may have a pair of shoulders 46 on terminal ends of a minor length thereof, where the shoulders 46 are configured for engaging with respective flanges 26, 30 of the channel 22 to receivably engage the cover 44 with the channel 22 to conceal a power cord 50 carried within the channel 22. As illustrated, the cover 44 can be installed by slidably positioning the cover 44 from an end of the channel 22, but may also be installed by expanding a mouth portion of the cover 44 to larger than a cross-section defined by flanges 26, 30 and then releasing the cover 44 into place.

Figure 3:
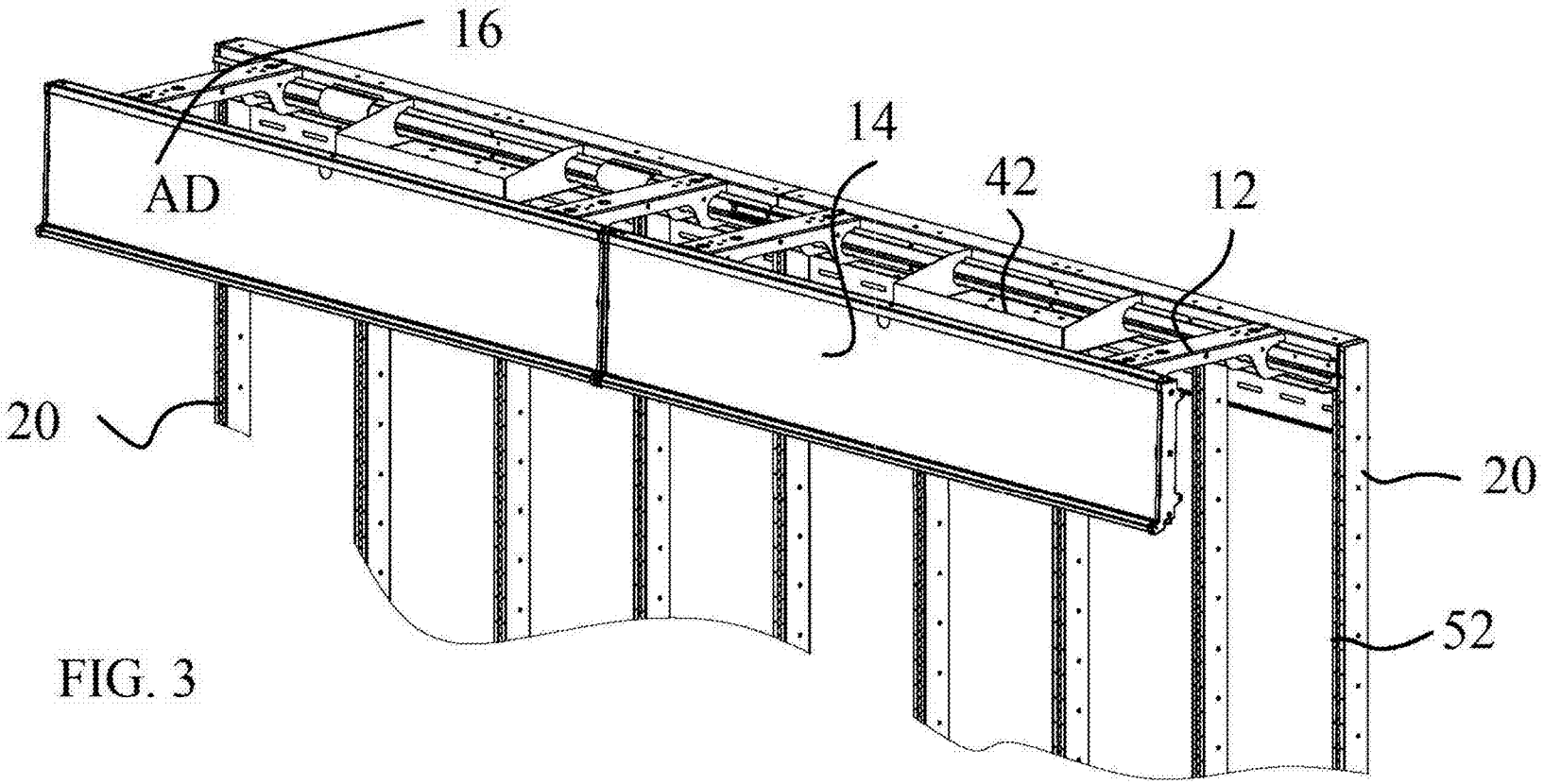
FIG. 3 illustrates a perspective view of a channel support having a panel with advertising indicia thereon according to one or more embodiments disclosed herein.

As illustrated in FIG. 3 and with more detailed reference to FIG. 6, a shelf platform 42 having a pair of shoulders 46 may be provided, wherein the shoulders 46 are configured for engaging with respective flanges 26, 30 of the channel 22 to receivably engage the shelf platform 42 with the channel 22. The shelf platform 42 may be provided for housing a power supply or for any other suitable reason.

In operation, a panel 14 with preferred advertising indicia 16 is selected. The panel may have a certain width, or it may be cut to width by a user. The panel 14 may be selectively engageable with the bracket 12 so that any desired spacing and number of brackets may be employed. In some embodiments, the operator may determine a desired width of spacing of product to fit on the shelves. For example, if the operator desires 5 "columns" of merchandise A, the operator may determine that corresponds to 15 inches in length, select a panel 14 that is about 15 inches in length, and then install the panel 14 above the merchandise A section. Similarly, the if the operator then desires 6 "columns" of merchandise B, that may correspond to 30 inches in length since the merchandise is larger, and the operator would then find a panel that is 30 inches in length.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A merchandise display stand comprising:

a pair of brackets for carrying a panel having advertising indicia on a first end thereof;

a plurality of spaced-apart upright supports;

a channel extending across a horizontal support that spans the spaced-apart upright supports, wherein the channel defines an upper flange and a lower flange, wherein there is defined a mounting gap from a rear facing surface of the upper flange and the horizontal support, wherein there is defined a mounting gap from a rear facing surface of the lower flange and the horizontal support, wherein the upper and lower flange define a space therebetween for selectively receiving a power cord;

wherein each bracket defines an upper shoulder extending from a top facing surface of the bracket for engaging the mounting gap defined by the upper flange, wherein the upper and lower flanges each define a slot extending therethrough to define an opening to allow insertion of the shoulders of the bracket, wherein each bracket defines a lower shoulder extending from a bottom facing surface of the bracket for engaging the mounting gap defined by the lower flange, wherein the lower shoulder comprises a pair of horizontally spaced-apart hooks, each hook defining a flat surface for extending through the slot of the lower flange to allow ingress of each one of the pair of spaced-apart hooks from a position forward of the lower flange to the mounting gap defined by the lower flange.

2. The merchandise display stand of claim 1, wherein placement of the pair of brackets along the channel occurs in response to sliding of the brackets along a length of the channel such that the upper shoulder is received in the mounting gap of the upper flange and the lower shoulder is received in the mounting gap of the lower flange.

3. The merchandise display stand of claim 2, wherein each bracket defines a set screw on a top surface thereof that extends through the bracket into an upward facing surface of the upper flange.

4. The merchandise display stand of claim 1, further including a shelf platform having a pair of shoulders configured for engaging with respective flanges of the channel to receivably engage the shelf platform with the channel.

5. The merchandise display stand of claim 1, further comprising a cover that defines a major length thereof, the cover having a pair of shoulders on terminal ends of a minor length thereof and configured for engaging with respective flanges of the channel to receivably engage the cover with the channel to conceal a power cord carried within the channel.

6. The merchandise display stand of claim 1, further including recesses in the spaced-apart upright supports for receiving a hook and anchor of a shelving system for supporting merchandise.

7. The merchandise display stand of claim 1, wherein a support extends from the horizontal support at a position spaced-below the flanges for providing an area of increased rigidity, wherein the horizontal support is continuous with the channel.

8. The merchandise display stand of claim 1, wherein the channel is positioned external to the horizontal support.

9. The merchandise display stand of claim 1, wherein the brackets are of rigid construction.

10. A merchandise display stand comprising:

a pair of rigid brackets for carrying a panel having advertising indicia on a first end thereof;

a plurality of spaced-apart upright supports;

a channel extending across a horizontal support that spans the spaced-apart upright supports, wherein the channel defines an upper and lower flange, wherein the upper and lower flange define a space therebetween for selectively receiving a power cord, wherein each bracket defines an upper shoulder extending from a top facing surface of the bracket for engaging the mounting gap defined by the upper flange, wherein the upper and lower flanges each define a slot extending therethrough to define an opening to allow insertion of the shoulders of the bracket, wherein there is defined a mounting gap from a rear facing surface of the upper flange and the horizontal support, wherein there is defined a mounting gap from a rear facing surface of the lower flange and the horizontal support, wherein each bracket defines a lower shoulder extending from a bottom facing surface of the bracket for engaging the mounting gap defined by the lower flange, wherein the lower shoulder comprises a pair of horizontally spaced-apart hooks, each hook defining a flat surface for extending through the slot of the lower flange to allow ingress of each one of the pair of spaced-apart hooks from a position forward of the lower flange to the mounting gap defined by the lower flange;

wherein placement of the pair of rigid brackets occurs in response to sliding of the brackets along a length of the channel, wherein the channel is positioned external to the horizontal support.

11. The merchandise display stand of claim 10, wherein each bracket defines a set screw on a top surface thereof that extends through the bracket into an upward facing surface of the upper flange.

12. The merchandise display stand of claim 10, further including a shelf platform having a pair of shoulders configured for engaging with respective flanges of the channel to receivably engage the shelf platform with the channel.

13. The merchandise display stand of claim 10, further comprising a cover that defines a major length thereof, the cover having a pair of shoulders on terminal ends of a minor length thereof and configured for engaging with respective flanges of the channel to receivably engage the cover with the channel to conceal a power cord carried within the channel.

14. The merchandise display stand of claim 10, further including recesses in the spaced-apart upright supports for receiving a hook and anchor of a shelving system for supporting merchandise.

15. The merchandise display stand of claim 10, wherein the upper and lower flanges each comprise addition slots at equally spaced portions along a length of the flanges to allow insertion of the shoulders of the bracket.

* * * * *